US009686622B2

(12) United States Patent
Inagaki

(10) Patent No.: US 9,686,622 B2
(45) Date of Patent: Jun. 20, 2017

(54) ACOUSTIC REPRODUCTION DEVICE AND SOUND-COLLECTING ACOUSTIC REPRODUCTION DEVICE

(71) Applicant: KYOCERA CORPORATION, Kyoto (JP)

(72) Inventor: Tomohiro Inagaki, Yokohama (JP)

(73) Assignee: KYOCERA Corporation, Kyoto (JP)

( * ) Notice: Subject to any disclaimer, the term of this patent is extended or adjusted under 35 U.S.C. 154(b) by 0 days.

(21) Appl. No.: 14/786,380

(22) PCT Filed: Apr. 23, 2014

(86) PCT No.: PCT/JP2014/062038

§ 371 (c)(1),
(2) Date: Oct. 22, 2015

(87) PCT Pub. No.: WO2014/175466

PCT Pub. Date: Oct. 30, 2014

(65) Prior Publication Data

US 2016/0100262 A1 Apr. 7, 2016

(30) Foreign Application Priority Data

Apr. 25, 2013 (JP) ..... 2013-093037

(51) Int. Cl.

| | |
|---|---|
| ***H04R 25/00*** | (2006.01) |
| *H04R 17/00* | (2006.01) |
| *H04R 25/02* | (2006.01) |

(52) U.S. Cl.

CPC ..... *H04R 25/604* (2013.01); *H04R 17/00* (2013.01); *H04R 25/02* (2013.01); *H04R 2460/09* (2013.01); *H04R 2460/13* (2013.01)

(58) Field of Classification Search

CPC ..... H04R 25/04; H04R 25/02; H04R 1/1008; H04R 17/00; H04R 2460/09; H04R 2460/13

See application file for complete search history.

(56) References Cited

U.S. PATENT DOCUMENTS 8,521,239 B2 8/2013 Hosoi et al.
2007/0230727 A1* 10/2007 Sanguino ..... H04R 25/554 381/315

(Continued)

FOREIGN PATENT DOCUMENTS

EP 3 007 466 A1 4/2016
JP 2003-264882 A 9/2003

(Continued)

OTHER PUBLICATIONS

International Search Report and Written Opinion from PCT/JP2014/062038 dated Jun. 24, 2014.

(Continued)

*Primary Examiner* — Tuan D Nguyen
(74) *Attorney, Agent, or Firm* — Studebaker & Brackett PC

(57) ABSTRACT

This acoustic reproduction device can suppress a loss in sense of volume and sense of comfort. The acoustic reproduction device causes a user to hear sound and is provided with a vibration unit (10), which includes a piezoelectric element (101) that flexes and a panel (102) that vibrates by being bent directly by the piezoelectric element (101), and with a holder (60), which holds the vibration unit (10) at a position where the vibration unit (10) contacts the user's ear.

14 Claims, 11 Drawing Sheets

(56) References Cited

U.S. PATENT DOCUMENTS

| | | | | |
|---|---|---|---|---|
| 2009/0290730 | A1 | 11/2009 | Fukuda et al. | |
| 2012/0082331 | A1* | 4/2012 | Meosky ..... | H04R 25/65<br>381/323 |
| 2012/0289162 | A1 | 11/2012 | Hosoi et al. | |

FOREIGN PATENT DOCUMENTS

| | | | |
|---|---|---|---|
| JP | 2005-348193 | A | 12/2005 |
| JP | 2006-304147 | A | 11/2006 |
| JP | 2007-103989 | A | 4/2007 |
| JP | 2007-165938 | A | 6/2007 |
| JP | 2010-192975 | A | 9/2010 |
| JP | 2012-204855 | A | 10/2012 |
| WO | 2008029515 | A1 | 3/2008 |
| WO | 2012/021424 | A1 | 2/2012 |

OTHER PUBLICATIONS

Murata, "Piezoelectric Sound Components," XP055315782, Oct. 11, 2003, URL: https://web.archive.org/web/20031011160542/http://www.aurelienr/com/electronique/piezo/applic.pdf [retrieved on Nov. 2, 2016], pp. 84-87.

Kyocera Corp., Extended European Search Report from EP Appl No. 14788577.6 dated Nov. 16, 2016, 9 pp.

* cited by examiner

ACOUSTIC REPRODUCTION DEVICE AND SOUND-COLLECTING ACOUSTIC REPRODUCTION DEVICE

CROSS-REFERENCE TO RELATED APPLICATION

This application claims priority to and the benefit of Japanese Patent Application No. 2013-93037 filed Apr. 25, 2013, the entire contents of which are incorporated herein by reference.

TECHNICAL FIELD

This disclosure relates to an acoustic reproduction device and a sound-collecting acoustic reproduction device, such as a hearing aid or the like.

BACKGROUND

In one type of acoustic reproduction device, such as an open fitting hearing aid, a vent connecting the inside of the external ear canal to the outside is provided to alleviate an occlusion effect when wearing the hearing aid (for example, see JP 2006-304147 A (PTL 1)). FIG. 10 schematically illustrates one type of hearing aid 90. This hearing aid 90 includes a microphone 91, an earphone 92, and a vent 93. The microphone 91 collects sound from a sound source, and the earphone 92 causes the user to hear the sound collected by the microphone 91. The vent 93 is a hole connecting the inside of the external ear canal to the outside, as described above. As a result of the vent 93, the external ear canal is not completely sealed. Therefore, the occlusion effect that occurs when wearing the hearing aid 90 is alleviated.

CITATION LIST

Patent Literature

PTL 1: JP 2006-304147 A

SUMMARY

Technical Problem

In this open fitting hearing aid 90, noise produced by the earphone 92 passes through the external ear canal and reaches the eardrum (path i in FIG. 10). Among the sound produced by the earphone 92, low-frequency sound escapes to the outside through the vent 93 (path ii). In addition to sound from the earphone 92, sound from the sound source passes through the vent 93 and reaches the eardrum directly (path iii). FIGS. 11(*a*) to 11(*d*) schematically illustrate acoustic characteristics of the hearing aid 90. FIG. 11(*a*) illustrates the acoustic characteristics of sound emitted by the earphone 92 near the earphone 92. FIG. 11(*b*) illustrates the acoustic characteristics of sound reaching the eardrum by path i. In the acoustic characteristics illustrated in FIG. 11(*b*), the sound pressure of low-frequency sound is lower than in the acoustic characteristics near the earphone 92. FIG. 11(*c*) illustrates the acoustic characteristics of sound reaching the eardrum by path iii. FIG. 11(*d*) illustrates the acoustic characteristics for a combination of sounds by path i and path iii, i.e. the actual acoustic characteristics heard by a user wearing a hearing aid. In the acoustic characteristics in FIG. 11(*d*), the sound pressure of low-frequency sound is reduced by the amount of low-frequency sound that escapes through the vent 93, thereby impairing a sense of volume. Reducing the diameter of the vent 93 in order to prevent low-frequency sound from escaping, however, brings about an occlusion effect, thereby impairing a sense of comfort when wearing the hearing aid.

It would therefore be helpful to provide an acoustic reproduction device and a sound-collecting acoustic reproduction device that can suppress a loss in sense of volume and sense of comfort.

Solution to Problem

In order to solve the above problem, an acoustic reproduction device according to this disclosure for causing a user to hear sound includes:

a vibration unit including a piezoelectric element that flexes and a panel that vibrates by being bent directly by the piezoelectric element; and a holder configured to hold the vibration unit at a position where the vibration unit contacts the user's ear.

In the acoustic reproduction device, the vibration unit may cause the user to hear sound by contacting the user's tragus from inside the user's ear and transmitting vibration of the panel to the tragus.

In the acoustic reproduction device, the vibration unit may cause the user to hear sound by contacting the user's antitragus from inside the user's ear and transmitting vibration of the panel to the antitragus.

In the acoustic reproduction device, the vibration unit may further include a pressing member that presses the vibration unit against the position where the vibration unit contacts the user's ear.

In the acoustic reproduction device, the pressing member may be detachably held against the vibration unit.

The acoustic reproduction device may be configured not to completely seal the user's external ear canal.

In the acoustic reproduction device, the panel may vibrate with an antinode at a central region of the panel and a node on both sides of the antinode, and a location at the central region of the panel may contact the tragus.

In the acoustic reproduction device, the panel may vibrate with an antinode at a central region of the panel and a node on both sides of the antinode, and a location at the central region of the panel may contact the antitragus.

In the acoustic reproduction device, the vibration unit may cause the user to hear sound by contacting the user's tragus from outside the user's ear and transmitting vibration of the panel to the tragus.

In the acoustic reproduction device, the vibration unit may cause the user to hear sound by contacting the user's antitragus from outside the user's ear and transmitting vibration of the panel to the antitragus.

The sound-collecting acoustic reproduction device may further include:

a microphone; such that the user's ear is positioned between the microphone and the vibration unit.

In the sound-collecting acoustic reproduction device, the vibration unit may generate an external ear canal radiated sound inside the user's ear.

In the sound-collecting acoustic reproduction device, the vibration unit may be pressed against the user's ear with a force of 0.1 N to 3 N.

In the sound-collecting acoustic reproduction device, the piezoelectric element may be plate-shaped, and the panel may have an area between 0.8 and 10 times an area of a principal surface of the piezoelectric element.

In the sound-collecting acoustic reproduction device, the holder may have a predetermined weight, and by the weight, a force may be produced in a direction in which the vibration unit contacts the user's ear.

Advantageous Effect

The disclosed acoustic reproduction device and sound-collecting acoustic reproduction device prevent a sense of volume and a sense of comfort, features which are difficult to combine, from both being greatly impaired.

DETAILED DESCRIPTION

The following describes embodiments of the disclosed devices.

(Embodiment)

Figure 1:
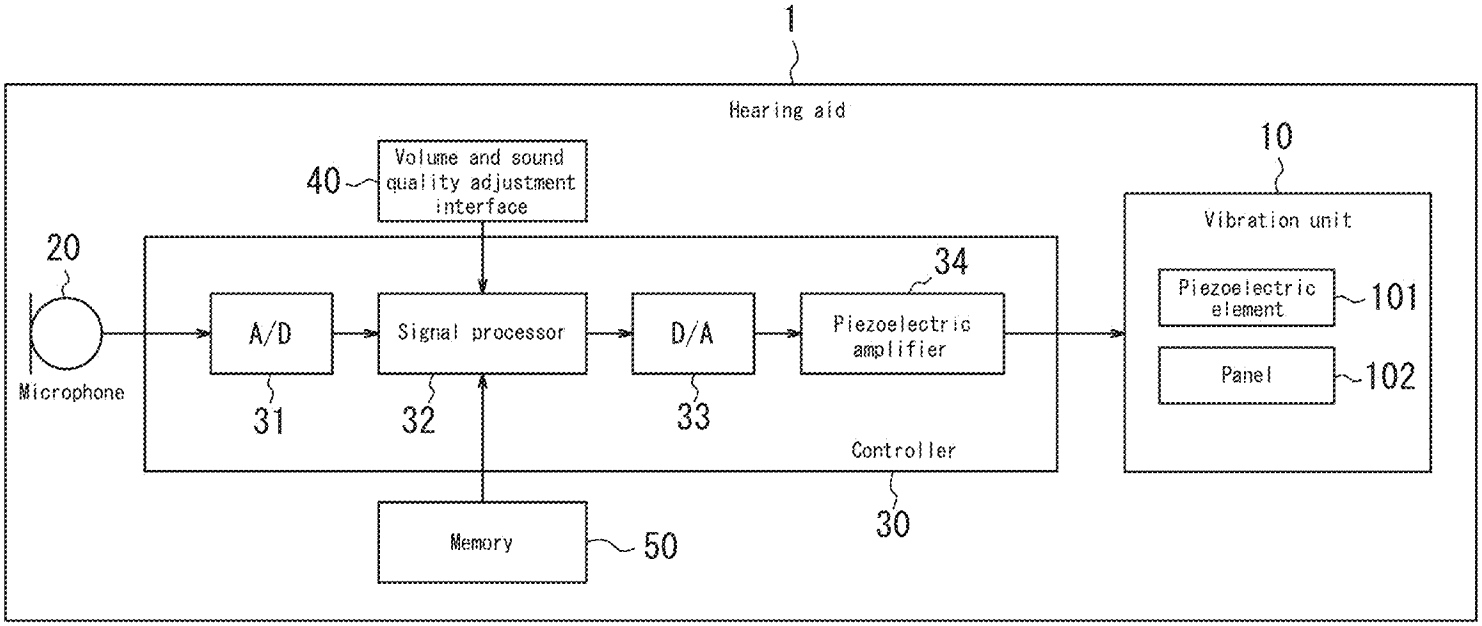
FIG. 1 is a block diagram illustrating a hearing aid according to one of the disclosed embodiments.

FIG. 1 is a block diagram of an acoustic reproduction device 1 according to one of the disclosed embodiments. The acoustic reproduction device 1 is, for example, a hearing aid 1 and includes a vibration unit 10, a microphone 20, a controller 30, a volume and sound quality adjustment interface 40, and a memory 50.

Figure 2:
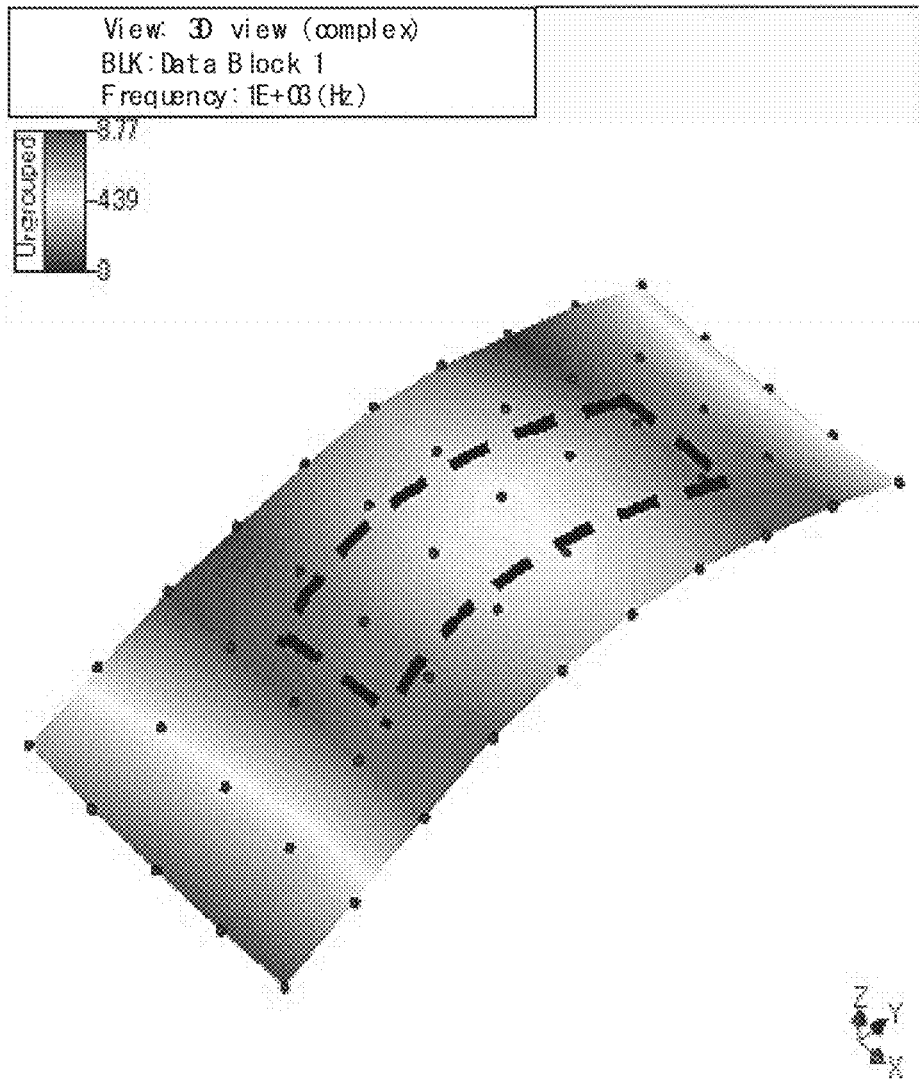
FIG. 2 schematically illustrates flexure of a panel and a piezoelectric element in a hearing aid according to one of the disclosed embodiments.

The vibration unit 10 includes a piezoelectric element 101 that flexes and a panel 102 that vibrates by being bent directly by the piezoelectric element 101. FIG. 2 schematically illustrates flexing of the panel 102 due to the piezoelectric element 101. The vibration unit 10 causes the user to hear air-conducted sound and human body vibration sound due to vibration. Air-conducted sound is sound transmitted to the user's auditory nerve by air vibrations, caused by a vibrating object, that are transmitted through the external ear canal to the eardrum and cause the eardrum to vibrate. Human body vibration sound is sound that is transmitted to the user's auditory nerve through a portion of the user's body (such as the cartilage of the outer ear) that is contacting a vibrating object.

The piezoelectric element 101 is formed by elements that, upon application of an electric signal (voltage), either expand and contract or bend (flex) in accordance with the electromechanical coupling coefficient of their constituent material. Ceramic or crystal elements, for example, may be used. The piezoelectric element 101 may be a unimorph, bimorph, or laminated piezoelectric element. Examples of a laminated piezoelectric element include a laminated unimorph element with layers of unimorph (for example, 16 or 24 layers) and a laminated bimorph element with layers of bimorph (for example, 16 or 24 layers). Such a laminated piezoelectric element may be configured with a laminated structure formed by a plurality of dielectric layers composed of, for example, lead zirconate titanate (PZT) and electrode layers disposed between the dielectric layers. Unimorph expands and contracts upon the application of an electric signal (voltage), and bimorph bends upon the application of an electric signal (voltage).

The panel 102 is, for example, made from glass or a synthetic resin such as acrylic or the like. An exemplary shape of the panel 102 is a plate, and the shape of the panel 102 is described below as being a plate.

The microphone 20 collects sound from a sound source, namely sound reaching the user's ear.

The controller 30 executes various control pertaining to the hearing aid 1. The controller 30 applies a predetermined electric signal (a voltage corresponding to a sound signal) to the piezoelectric element 101. In greater detail, in the controller 30, an A/D converter 31 converts a sound signal collected by the microphone 20 into a digital signal. Based on information on volume, sound quality, and the like from the volume and sound quality adjustment interface 40 and on information stored in the memory 50, a signal processor 32 outputs a digital signal that drives the vibration unit 10. A D/A converter 33 converts the digital signal to an analog electric signal, which is then amplified by a piezoelectric amplifier 34. The resulting electric signal is applied to the piezoelectric element 101. The voltage that the controller 30 applies to the piezoelectric element 101 may, for example, be ±15 V. This is higher than ±5 V, i.e. the applied voltage of a so-called panel speaker for conduction of sound by air-conducted sound rather than human body vibration sound. In this way, sufficient vibration is generated in the panel 102, so that a human body vibration sound can be generated via a part of the user's body. Note that the magnitude of the applied voltage used may be appropriately adjusted in accordance with the fixation strength of the panel 102 or the performance of the piezoelectric element 101. Upon the controller 30 applying the electric signal to the piezoelectric element 101, the piezoelectric element 101 expands and contracts or bends in the longitudinal direction.

At this point, the panel 102 to which the piezoelectric element 101 is attached vibrates by deforming in conjunction with the expansion and contraction or bending of the piezoelectric element 101. The panel 102 flexes due to expansion and contraction or to bending of the piezoelectric element 101. The panel 102 is bent directly by the piezoelectric element 101. Stating that "the panel 102 is bent directly by the piezoelectric element 101" differs from the phenomenon utilized in known panel speakers, whereby the panel 102 deforms upon vibration of a particular region of the panel 102 due to the inertial force of a piezoelectric actuator constituted by disposing the piezoelectric element 101 in the casing. Stating that "the panel 102 is bent directly by the piezoelectric element 101" refers instead to how expansion and contraction or bending (flexure) of the piezoelectric element 101 directly bends the panel 102 via the joining member.

Since the panel 102 vibrates as described above, the panel 102 generates air-conducted sound, and when the user contacts the panel 102 to the tragus, the panel 102 generates human body vibration sound via the tragus. The panel 102 preferably vibrates with locations near the edges of the panel 102 as nodes and the central region as an antinode, and a location at the central region of the panel 102 preferably contacts the tragus or antitragus. As a result, vibration of the panel 102 can be efficiently transmitted to the tragus or the antitragus.

Figure 3:
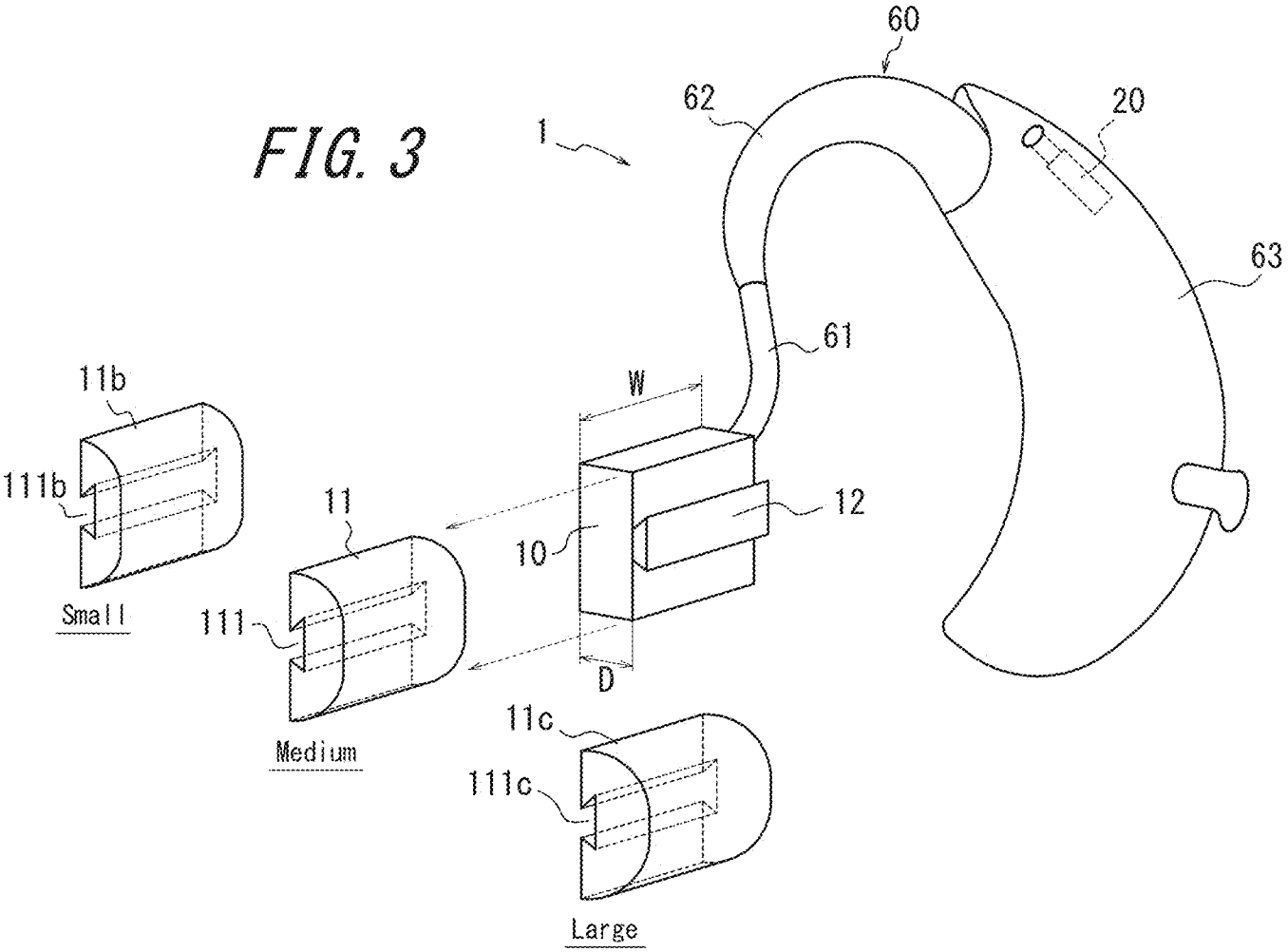
FIG. 3 illustrates the state of a hearing aid 1 when a pressing member is detached.

FIG. 3 schematically illustrates the structure of the hearing aid 1 according to one of the disclosed embodiments. As illustrated in FIG. 3, the vibration unit 10 includes a pressing member 11 and an attaching portion 12 for the pressing member. The pressing member 11 is attached to the vibration unit 10. For example when the vibration unit 10 contacts the user's tragus, then by the pressing member 11 contacting a portion of the external ear canal opposite the tragus, for example a location near the antitragus, the pressing member 11 presses the vibration unit 10 into the position of contact with the tragus. The position where the vibration unit 10 contacts the user's ear may, for example, be the tragus, antitragus, concha auriculae, or auricle. In this embodiment, an example is described in which the position of contact with the user's ear is the tragus (the inner wall of the external ear canal by the tragus).

The attaching portion 12 for the pressing member is a member for attaching the pressing member 11 to the vibration unit 10. The pressing member 11 and the attaching portion 12 are shaped to fit each other. The pressing member 11 preferably includes a concave cutout portion 111, and the attaching portion 12 preferably has a convex shape that fits into the cutout portion 111. The pressing member 11 can be detached from the vibration unit 10 by sliding in the width direction. The vibration unit 10 preferably has a thickness (D) of 4 mm or less and a width (W) of 15 mm or less. If the size is within this range, the vibration unit 10 can fit within the external ear canal of the user's ear regardless of gender or age (except for toddlers and below). The pressing member 11 also preferably comes in three sizes (small, medium, and large), with one of the pressing members 11, 11*b*, and 11*c* being selected in accordance with the size of the user's ear and attached to the attaching portion 12 for the pressing member.

A holder 60 includes a support 61, an ear hook 62, and a body 63. The holder 60 holds the vibration unit 10 at the position at which the vibration unit 10 contacts the user's ear (the inner wall of the external ear canal by the tragus). One end of the support 61 is connected to the vibration unit 10. The support 61 has a hollow structure, and a lead wire is fed to the vibration unit 10 through this hollow structure. The support 61 is rigid enough so that the angle of the vibration unit 10 does not change. The other end of the support 61 is connected to one end of the ear hook 62.

The ear hook 62 contacts the outside of the user's auricle to mount the hearing aid 1 in the user's ear. The ear hook 62 is preferably shaped as a hook conforming to the user's auricle so as to mount the hearing aid 1 stably in the user's ear. The other end of the ear hook 62 is connected to the body 63. The body 63 stores the microphone 20, controller 30, volume and sound quality adjustment interface 40, and memory 50 therein.

Figure 4:
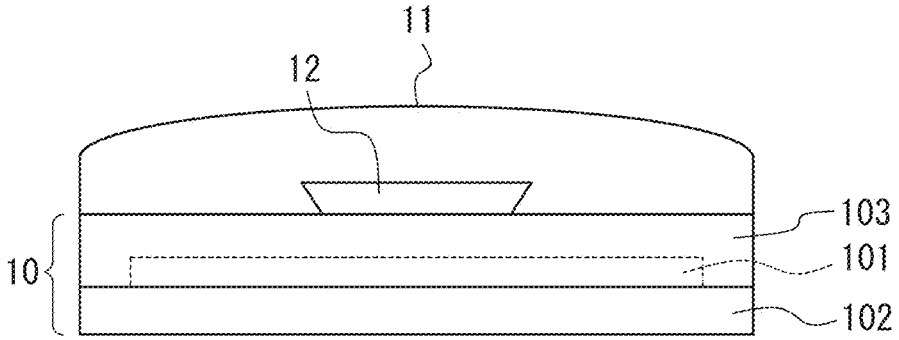
FIG. 4 is a side view in the thickness direction of a vibration unit.

FIG. 4 is a side view of the vibration unit 10 as viewed in the thickness direction. As described above, the vibration unit 10 includes the piezoelectric element 101 and the panel 102. The piezoelectric element 101 is preferably shaped as a plate, as in FIG. 4.

The piezoelectric element 101 is joined to the panel 102 by a joining member. The joining member is disposed between the principal surface of the piezoelectric element 101 and the principal surface of the panel 102. The joining member is preferably a non-heat hardening adhesive material or double-sided tape.

Apart from the surface joined to the panel 102, the piezoelectric element 101 is covered by a mold 103. The pressing member 11 and the attaching portion 12 for the pressing member are provided at the top of the mold 103.

The principal surface of the panel 102 preferably has an area between 0.8 and 10 times the area of the principal surface of the piezoelectric element 101. If the principal surface of the panel 102 has an area between 0.8 and 10 times the area of the principal surface of the piezoelectric element 101, the panel 102 can deform in conjunction with expansion and contraction or bending of the piezoelectric element 101, and the area of contact with the user's ear can be sufficiently guaranteed. The area of the panel is, for example, more preferably between 0.8 and 5 times the area of the piezoelectric element.

Figure 5B:
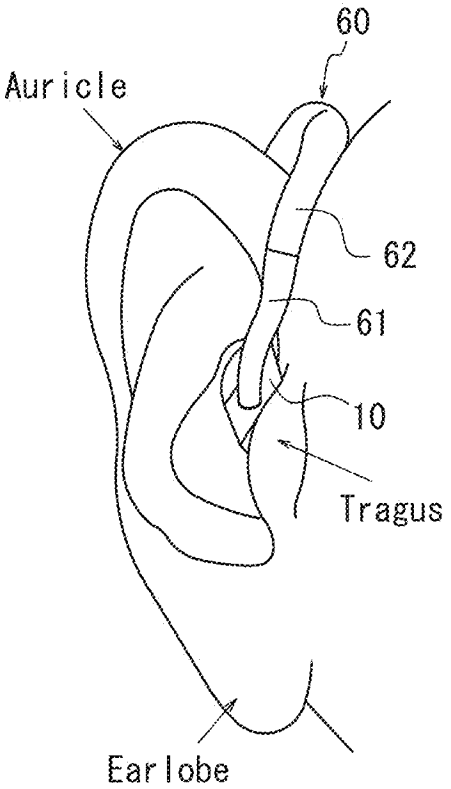
FIGS. 5(*a*) and 5(*b*) illustrate a hearing aid according to one of the disclosed embodiments as worn in a user's ear.
Figure 5A:
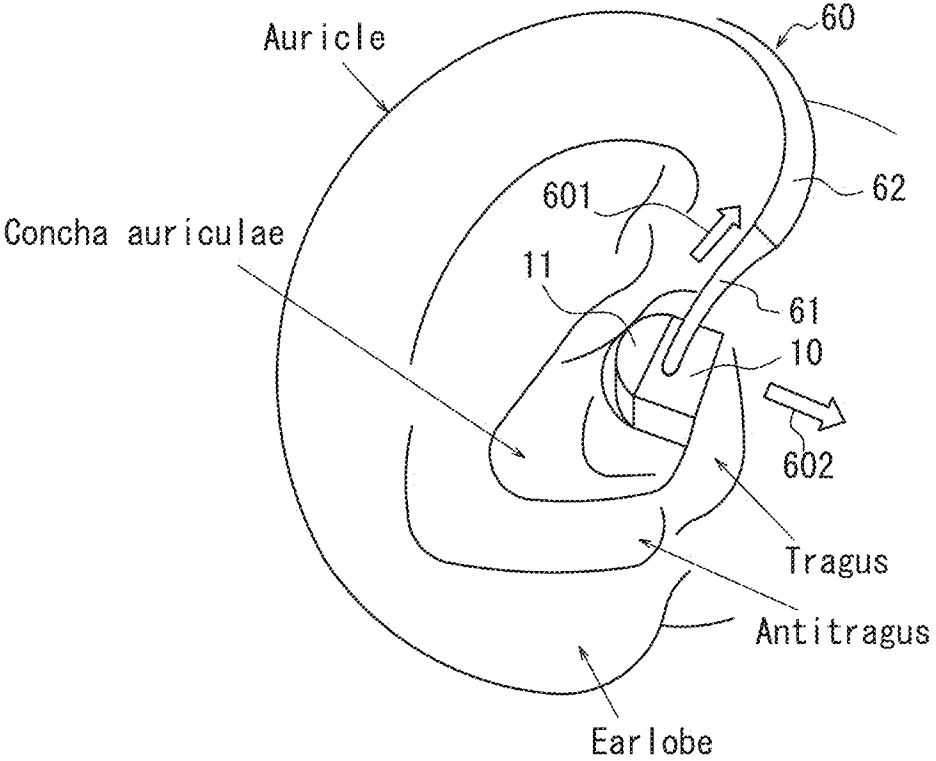

FIGS. 5(*a*) and 5(*b*) illustrate the hearing aid 1 according to one of the disclosed embodiments as worn in the user's ear. FIG. 5(*a*) is a front view of the ear, and FIG. 5(*b*) is a side view of the ear from the face. The hearing aid 1 causes the user to hear sound by contacting the vibration unit 10 to the user's tragus or antitragus from inside the user's ear and transmitting vibration to the tragus or the antitragus. Stating that the vibration unit 10 is "contacted to the user's tragus or antitragus from inside the user's ear" refers to how, when buried in the external ear canal, the vibration unit 10 is contacted to the tragus or antitragus from a position near the entrance of the external ear canal. In the example in FIGS. 5(*a*) and 5(*b*), the vibration unit 10 is contacted to the user's tragus from inside the user's ear. At this time, the pressing member 11 contacts a portion of the external ear canal opposite the tragus.

The vibration unit 10 illustrated in FIG. 5(*a*) is pulled via the support 61 in the direction of the arrow 601 by the weight of the holder 60, i.e. by the weight of the body 63 connected to the end of the ear hook 62. As illustrated in FIG. 5(*b*), since the vibration unit 10 contacts the tragus so as to be caught by the tragus, a force acts in the direction in which the vibration unit 10 contacts the user's ear (the direction of the arrow 602) when the vibration unit 10 is pulled. In other words, by the weight of the holder 60, a force (pressing force) is produced in the direction in which the vibration unit 10 contacts the user's ear. The holder 60 thus causes a pressing force to act on the vibration unit 10, thereby more reliably transmitting sound by vibration of the vibration unit 10.

The vibration unit 10 is preferably pressed against the user's ear with a force of 0.1 N to 3 N. If the vibration unit 10 is pressed with a force between 0.1 N and 3 N, vibration by the vibration unit 10 is sufficiently transmitted to the ear. Furthermore, if the pressure is a small force of less than 3 N, the user suffers little fatigue even when wearing the hearing aid 1 for an extended period of time, thus maintaining a sense of comfort when wearing the hearing aid 1.

As also illustrated in FIG. 5(*a*), the hearing aid 1 does not completely seal the external ear canal with the vibration unit 10 and the pressing member 11. Therefore, the hearing aid 1 does not cause an occlusion effect and remains comfortable when worn.

Next, the acoustic characteristics of the hearing aid 1 according to one of the disclosed embodiments are described with reference to FIGS. 6 through 8.

Figure 6:
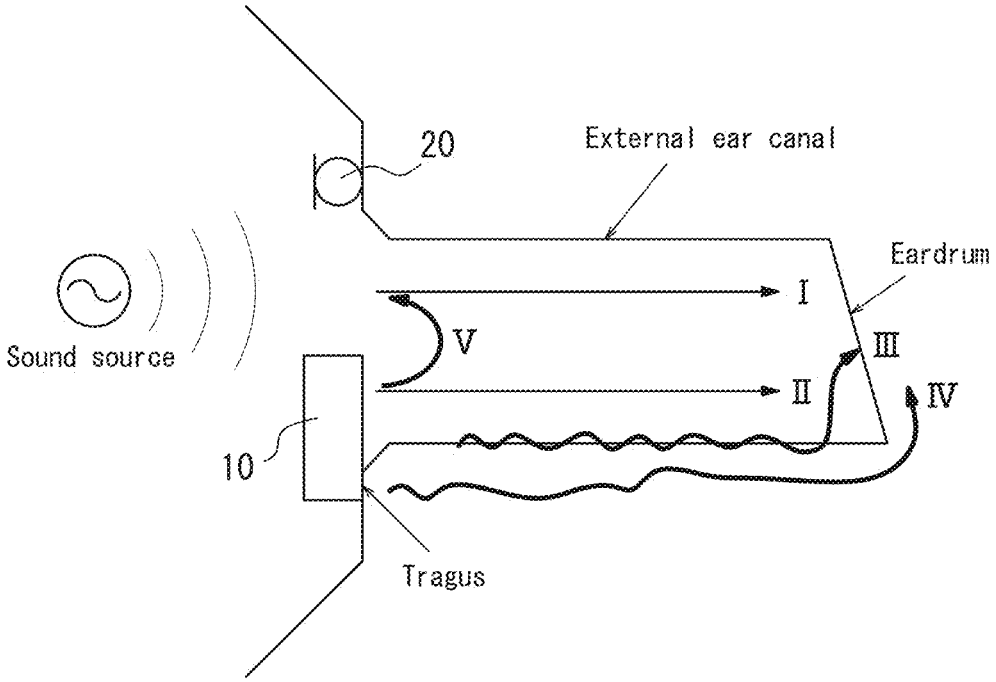
FIG. 6 schematically illustrates transmission of sound from a hearing aid according to one of the disclosed embodiments.
Figure 7A:
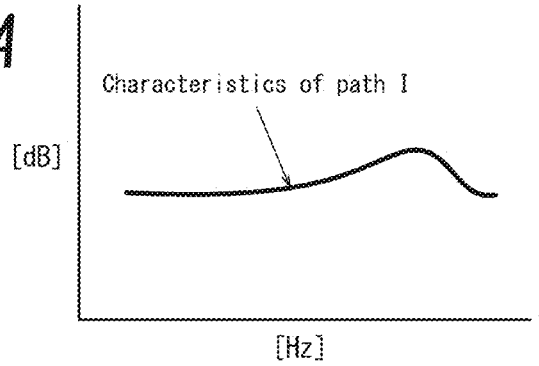
FIGS. 7(*a*) through 7(d) schematically illustrate acoustic characteristics of various paths.
Figure 7B:
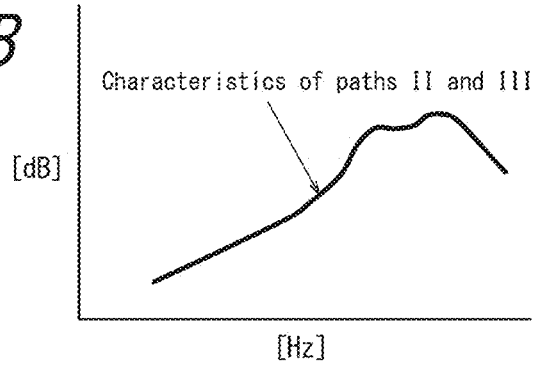
Figure 7C:
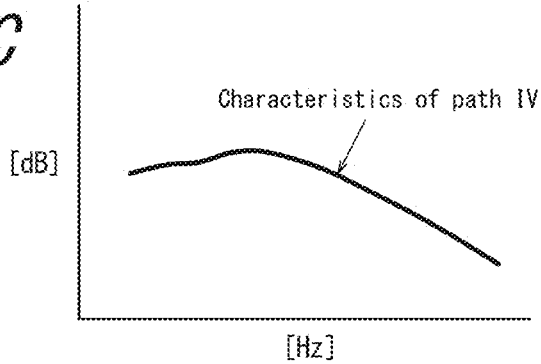
Figure 7D:
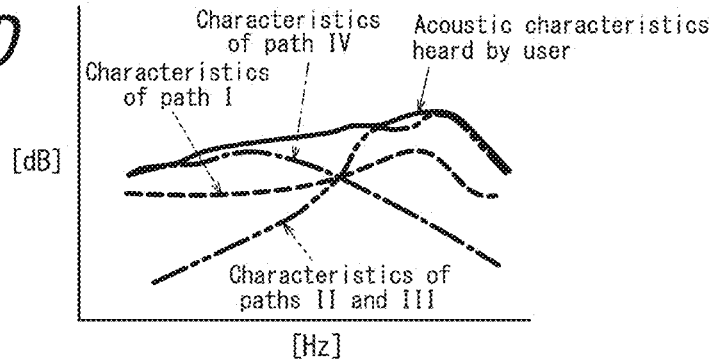

FIG. 6 schematically illustrates transmission of sound from the hearing aid 1 according to one of the disclosed embodiments. In FIG. 6, the only illustrated portions of the hearing aid 1 are the vibration unit 10 and the microphone 20. The microphone 20 collects sound from a sound source. By vibrating, the vibration unit 10 causes the user to hear the sound collected by the microphone 20.

As illustrated in FIG. 6, sound from the sound source passes through the external ear canal from a portion not covered by the vibration unit 10 and reaches the eardrum directly (path I). Air-conducted sound due to vibration of the vibration unit 10 also passes through the external ear canal and reaches the eardrum (path II). Due to the vibration of the vibration unit 10, at least the inner wall of the external ear canal vibrates, and sound due to this vibration of the external ear canal (external ear canal radiated sound) reaches the eardrum (path III). Furthermore, human body vibration sound due to the vibration of the vibration unit 10 reaches the auditory nerve directly without passing through the eardrum (path IV). A portion of the air-conducted sound produced by the vibration unit 10 escapes to the outside (path V).

FIGS. 7(*a*) through 7(d) schematically illustrate the acoustic characteristics of the various paths. FIG. 7(*a*) illustrates the acoustic characteristics of sound by path I, and FIG. 7(*b*) illustrates the acoustic characteristics of sound by path II and path III. For the sound by path II and path III, the sound pressure in the low-frequency sound region is low, since low-frequency sound escapes by path V. FIG. 7(*c*) illustrates the acoustic characteristics of path IV. As illustrated in FIG. 7(*c*), the human body vibration sound is low-frequency sound, i.e. vibration in a low-frequency region. Therefore, this sound does not dampen easily and hence is transmitted more easily than high-frequency sound. Accordingly, low-frequency sound is transmitted relatively well. FIG. 7(*d*) illustrates the acoustic characteristics for a combination of sounds by paths I through IV, i.e. the actual acoustic characteristics heard by a user wearing the hearing aid 1. As illustrated in FIG. 7(*d*), even though sound pressure of low-frequency sound escapes to the outside by path V, the sound pressure of low-frequency sound, namely sound pressure of low-frequency sound at 1 kHz or less in this embodiment, can be guaranteed by the human body vibration sound, thereby maintaining a sense of volume.

Figure 8:
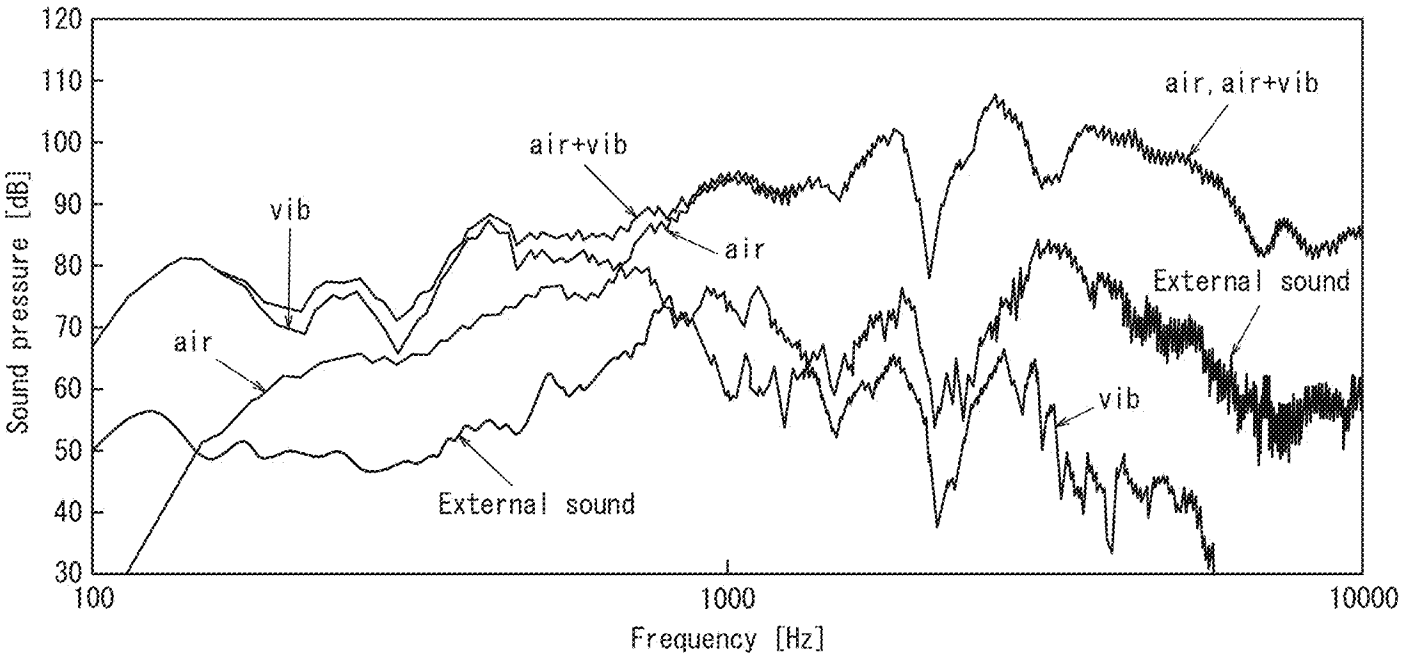
FIG. 8 illustrates measured values of the acoustic characteristics of a hearing aid according to one of the disclosed embodiments.

FIG. 8 illustrates measured values of the frequency characteristics of the hearing aid 1. In FIG. 8, "air" represents the frequency characteristics of sound by path II and path III in FIG. 6, and "vib" represents the frequency characteristics of sound by path IV in FIG. 6. Furthermore, "air+vib" represents the frequency characteristics of sound yielded by combining the sound of path II through path IV. Finally, "external sound" represents the frequency characteristics of sound over path I in FIG. 6. As indicated by these measurement values, the sound pressure of low-frequency sound is transmitted by the human body vibration sound, thereby suppressing a loss in the sense of volume.

Figure 9A:
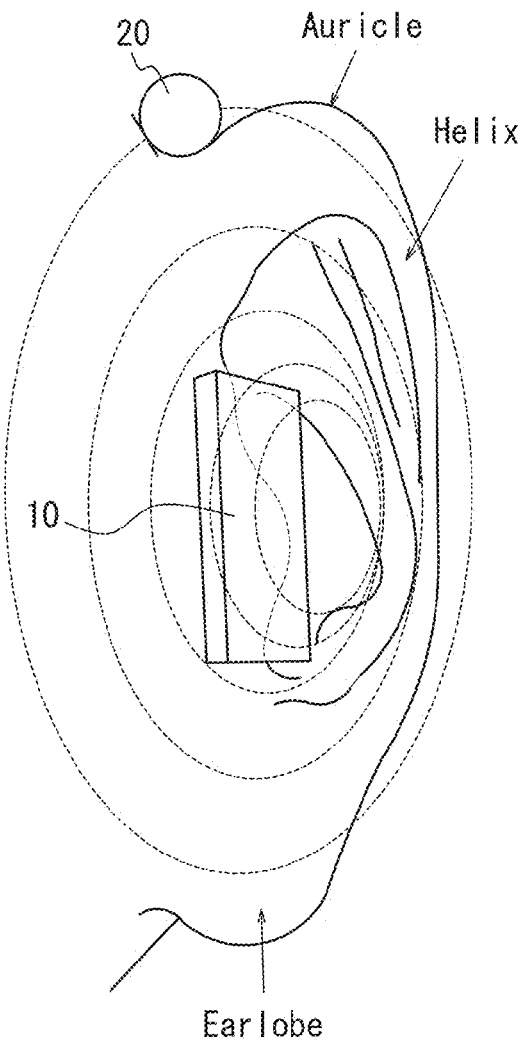
FIGS. 9(*a*) and 9(*b*) illustrate the relationship between the vibration unit and the microphone in a hearing aid according to one of the disclosed embodiments.
Figure 9B:
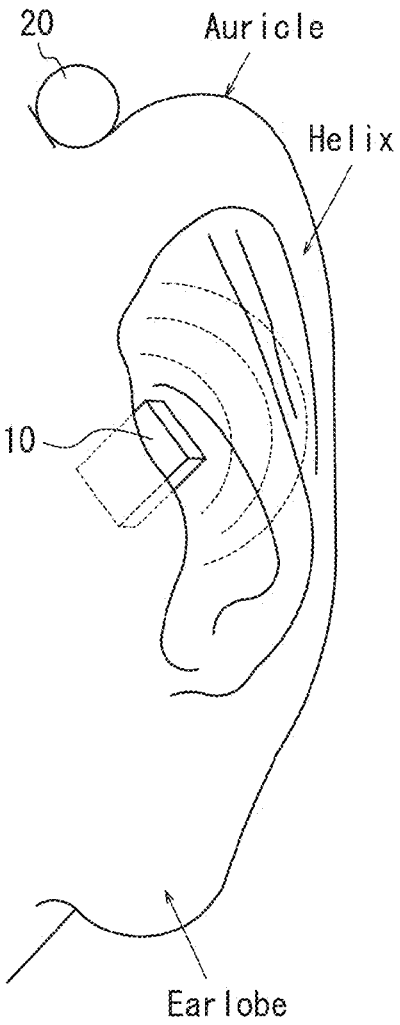
Figure 10:
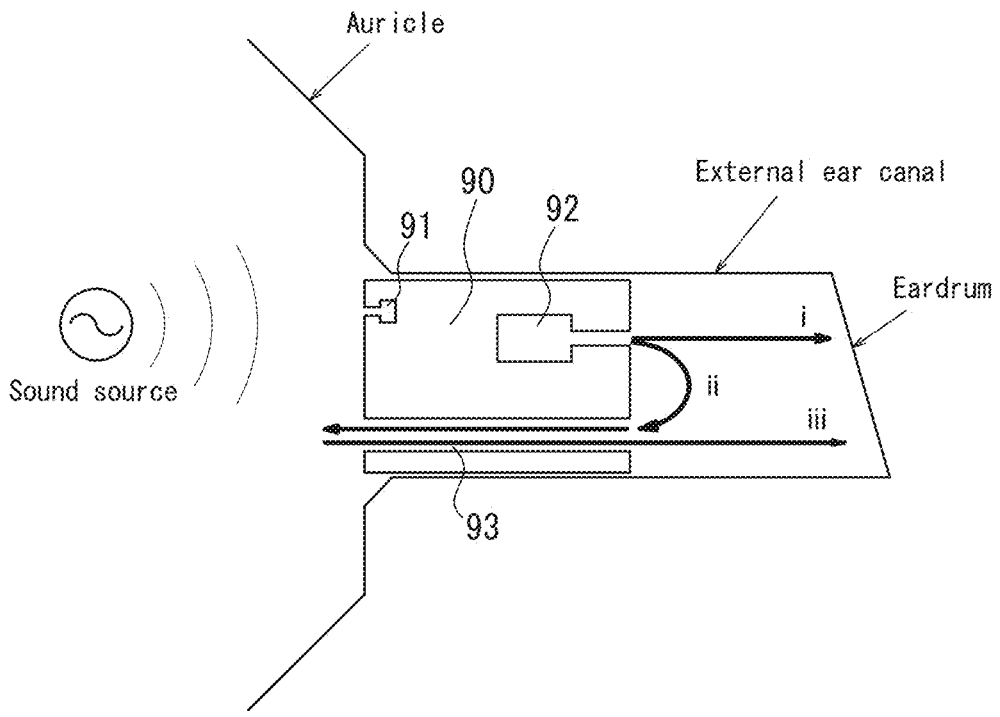
FIG. 10 schematically illustrates a type of hearing aid.
Figure 11A:
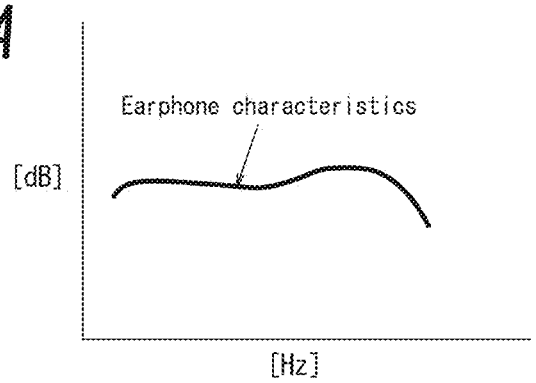
FIGS. 11(*a*) to 11(*d*) schematically illustrate acoustic characteristics of a type of hearing aid.
Figure 11B:
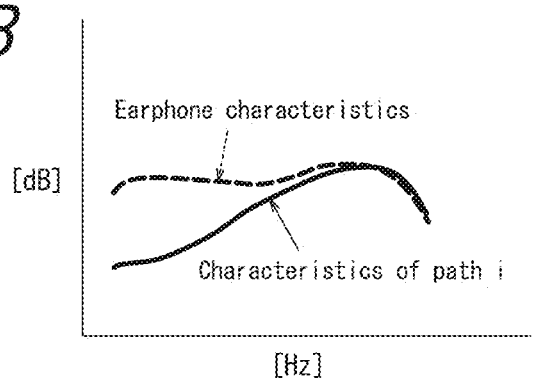
Figure 11C:
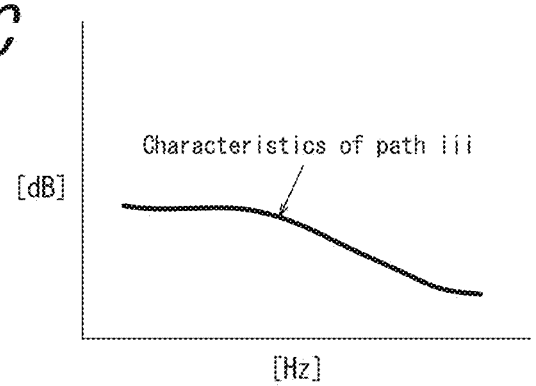
Figure 11D:
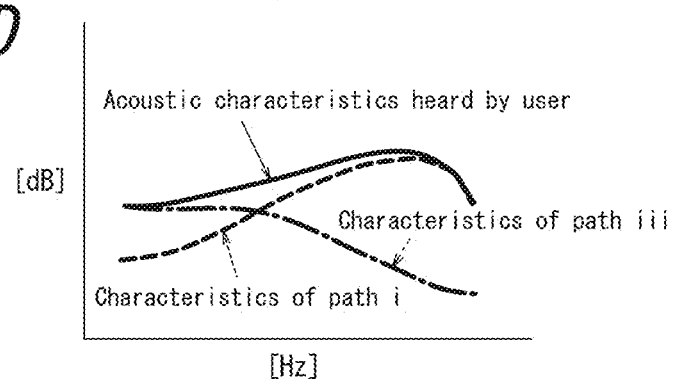

FIGS. 9(*a*) and 9(*b*) illustrate the relationship between the vibration unit 10 and the microphone 20 in the hearing aid 1 according to one of the disclosed embodiments. The microphone 20 is provided in the body 63 of the holder 60 and is therefore positioned on the outside of the auricle. FIG. 9(*a*) illustrates an example in which the vibration unit 10 is contacted to the user's tragus from outside the user's ear. In this case, nothing blocks the air-conducted sound generated by the vibration unit 10 from reaching the microphone 20. Therefore, a large amount of sound returns to the microphone 20, easily leading to howling and preventing improvement in the performance (amplification) of the hearing aid 1.

Conversely, the vibration unit 10 is contacted to the user's tragus from inside the user's ear in FIG. 9(*b*). In this case, the user's ear (mainly the tragus and the crus of helix) is positioned between the microphone 20 and the vibration unit 10. Therefore, sound generated by the vibration unit 10 is reflected by the user's ear, so that the amount of sound returning directly to the microphone 20 is less than in FIG. 9(*a*). As a result, howling is less likely to occur, and the performance of the hearing aid 1 can be improved.

As preferred examples of the user's ear position, it suffices for a peripheral portion of the ear, such as the helix, auricular tubercle, earlobe, or the like to be located between the microphone 20 and the vibration unit 10. Alternatively, apart from a peripheral portion, the inferior antihelix crus, antihelix, or the like may be located between the microphone 20 and the vibration unit 10.

As described above, according to the hearing aid 1, vibration of the vibration unit 10 causes the user's ear to hear sound. Sound pressure of low-frequency sound can thus be ensured by the human body vibration sound, suppressing a loss in the sense of volume. Furthermore, since it is unnecessary to provide a vent for preventing low-frequency sound from escaping, a loss in the sense of comfort when wearing the hearing aid 1 can be suppressed.

While an example in which the acoustic reproduction device is a hearing aid 1 has been described in this embodiment, this example is not limiting. For example, the acoustic reproduction device may be a headphone or earphone, in which case the microphone 20 is not provided. In this case, the acoustic reproduction device may reproduce sound based on music data stored in an internal memory of the acoustic reproduction device or sound based on music data stored on an external server or the like and transmitted over a network.

In this embodiment, while an example has been illustrated in which the user is caused to hear sound by contacting the vibration unit 10 to the user's tragus from inside the user's ear and transmitting vibration to the tragus, this example is not limiting. For example, the user may be caused to hear sound by contacting the vibration unit 10 to the user's antitragus from inside the user's ear and transmitting vibration to the antitragus. Furthermore, the user may be caused to hear sound by contacting the vibration unit 10 to the user's tragus or antitragus from outside the user's ear and transmitting vibration to the tragus or antitragus. "Contacting to the user's tragus or antitragus from outside the user's ear" refers to contacting the vibration unit 10 to the tragus or antitragus approximately in parallel with the cheek or temple, without burying the vibration unit 10 in the external ear canal.

Although this disclosure is based on embodiments and drawings, it is to be noted that various changes and modifications will be apparent to those skilled in the art based on this disclosure. Therefore, such changes and modifications are to be understood as included within the scope of this disclosure. For example, the functions and the like included in the various units and members may be reordered in any logically consistent way. Furthermore, units and members may be combined into one or divided.

REFERENCE SIGNS LIST

1 Acoustic reproduction device (hearing aid)
10 Vibration unit
11 Pressing member
12 Attaching portion
20 Microphone
30 Controller
31 A/D converter
32 Signal processor
33 D/A converter
34 Piezoelectric amplifier
40 Volume and sound quality adjustment interface
50 Memory
60 Holder
61 Support
62 Ear hook
63 Body
90 Hearing aid
91 Microphone
92 Earphone
93 Vent
101 Piezoelectric element
102 Panel
103 Mold
111 Cutout portion

The invention claimed is:

1. An acoustic reproduction device for causing a user to hear sound, comprising:

a vibration unit including a piezoelectric element that flexes and a panel that vibrates by being bent directly by the piezoelectric element; and a holder configured to hold the vibration unit at a position where the vibration unit contacts the user's ear, wherein the holder comprises a support, an ear hook, and a body section, said body section having a predetermined weight and being placed behind the user's ear, and by the weight of the body section and the user's ear acting as a lever, a force is produced in a direction in which the vibration unit contacts the user's ear.

2. The acoustic reproduction device of claim 1, wherein the vibration unit causes the user to hear sound by contacting the user's tragus from inside the user's ear and transmitting vibration of the panel to the tragus.

3. The acoustic reproduction device of claim 2, wherein the panel vibrates with an antinode at a central region of the panel and a node on both sides of the antinode, and a location at the central region of the panel contacts the tragus.

4. The acoustic reproduction device of claim 1, wherein the vibration unit causes the user to hear sound by contacting the user's antitragus from inside the user's ear and transmitting vibration of the panel to the antitragus.

5. The acoustic reproduction device of claim 4, wherein the panel vibrates with an antinode at a central region of the panel and a node on both sides of the antinode, and a location at the central region of the panel contacts the antitragus.

6. The acoustic reproduction device of claim 1, wherein the vibration unit further includes a pressing member that presses the vibration unit against the position where the vibration unit contacts the user's ear.

7. The acoustic reproduction device of claim 6, wherein the pressing member is detachably held against the vibration unit.

8. The acoustic reproduction device of claim 1, wherein the acoustic reproduction device does not completely seal the user's external ear canal.

9. The acoustic reproduction device of claim 1, wherein the vibration unit causes the user to hear sound by contacting the user's tragus from outside the user's ear and transmitting vibration of the panel to the tragus.

10. The acoustic reproduction device of claim 1, wherein the vibration unit causes the user to hear sound by contacting the user's antitragus from outside the user's ear and transmitting vibration of the panel to the antitragus.

11. The sound-collecting acoustic reproduction device of claim 1, further comprising:

a microphone; wherein the user's ear is positioned between the microphone and the vibration unit.

12. The sound-collecting acoustic reproduction device of claim 1, wherein the vibration unit generates an external ear canal radiated sound inside the user's ear.

13. The sound-collecting acoustic reproduction device of claim 1, wherein the vibration unit is pressed against the user's ear with a force of 0.1 N to 3 N.

14. The sound-collecting acoustic reproduction device of claim 1, wherein the piezoelectric element is plate-shaped, and the panel has an area between 0.8 and 10 times an area of a principal surface of the piezoelectric element.

* * * * *